US006918791B2

(12) United States Patent
Wan et al.

(10) Patent No.: US 6,918,791 B2
(45) Date of Patent: Jul. 19, 2005

(54) ELECTRICAL CONNECTOR HAVING A RELIABLE INTERNAL CIRCUIT BOARD

(75) Inventors: Qin Wan, Kunsan (CN); HongJun Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/982,099

(22) Filed: Nov. 4, 2004

(65) Prior Publication Data

US 2005/0101189 A1 May 12, 2005

(30) Foreign Application Priority Data

Nov. 11, 2003 (CN) ..... 200320110823

(51) Int. Cl.[7] ..... H01R 24/00
(52) U.S. Cl. ..... 439/620; 439/607; 439/676
(58) Field of Search ..... 439/620, 676, 439/607–610, 344, 76.1

(56) References Cited

U.S. PATENT DOCUMENTS

| | | | | |
|---|---|---|---|---|
| 5,069,641 | A | 12/1991 | Sakamoto et al. | |
| 5,647,767 | A | 7/1997 | Scheer et al. | |
| 6,719,588 | B1 * | 4/2004 | Zheng et al. | 439/620 |
| 6,776,651 | B1 * | 8/2004 | Liu | 439/490 |
| 6,786,772 | B1 * | 9/2004 | Liu | 439/620 |
| 6,811,442 | B1 * | 11/2004 | Lien et al. | 439/620 |
| 6,848,943 | B2 * | 2/2005 | Machado et al. | 439/607 |

* cited by examiner

*Primary Examiner*—Hien Vu
(74) *Attorney, Agent, or Firm*—Wei Te Chung

(57) ABSTRACT

An electrical connector (100) mounted on a main printed circuit board includes a dielectric housing (1) defining a receiving cavity (10) and an insert module (2) received in the housing. The insert module includes an insulative base (21) defining a groove (20), an internal circuit board (220) fixed in the groove and a number of conductive terminals (23) mounted on the base. Each terminal includes a body portion (230) fixed in the base, a contacting portion (231) extending upwardly and rearwardly from the body portion and exposed in the receiving cavity, and a mounting portion (232) extending rearwardly from the body portion for mounting on the internal circuit board.

5 Claims, 6 Drawing Sheets

ELECTRICAL CONNECTOR HAVING A RELIABLE INTERNAL CIRCUIT BOARD

BACKGROUND OF THE INVENTION

1. Field of the Invention

The present invention relates to electrical connectors and more particularly, to a modular jack having an internal circuit board therein.

2. Description of the Prior Art

Modular jack receptacle connectors are commonly used in the computers or network appliance as input/output ports for transmitting data or signals. With recent increases in the speed of data transmission, requirements have become important for modular jacks. Modular jacks commonly include internal printed circuit boards (PCB) carried signal conditioning components thereon for improving electric capability of the modular jack. An example of such a connector is disclosed in U.S. Pat. No. 5,069,641, issued to Sakamoto on Dec. 3, 1991. The Sakamoto connector includes an insulative housing having front and rear internal chambers, an internal PCB having a choke coil soldered thereto and a plurality of contacts soldered to the internal PCB. The internal PCB is encased in the rear chamber and the contacts extend into the front chamber for mating with a plug connector. However, the internal PCB is easily sways due to being mounted in the rear chamber of the housing without any retention. Thus, soldering joints between the contacts and the internal PCB are easily damaged during assembling Sakamoto connector and mating with the plug connector, so that a reliable electrical connection is not ensured.

U.S. Pat. No. 5,647,767 issued to Scheer et al. on Jul. 15, 1997 discloses a conventional connector. The Scheer connector includes an insulative housing and an insert subassembly received in the housing. The Subassembly comprises a front insert member having a plurality of terminals insert molded therein, a rear insert member having an internal PCB insert molded therein. The terminals of the insert member are soldered to the internal PCB. However, the Scheer connector needs two insert molding processes, thus increasing complexity of manufacturing. Furthermore, the rear insert member is molding after the terminals and other signal conditioning components soldered to the internal PCB. It is easy to damage some components during molding the rear insert member. In addition, the subassembly must be entirely disposed even only one component is damaged. This inevitably increases the manufacturing cost.

Hence, a need has existed for an electrical connector having a reliable internal PCB for overcoming the disadvantages of the foregoing shortcomings.

BRIEF SUMMARY OF THE INVENTION

A main object of the present invention is to provide an electrical connector with reliable internal PCB.

Another object of the present invention is to provide an electrical connector having an internal PCB for simplifying the manufacture and reducing cost.

An electrical connector mounted on a main printed circuit board includes a dielectric housing defining a receiving cavity and an insert module received in the housing. The insert module includes an insulative base defining a groove, an internal circuit board fixed in the groove and a number of conductive terminals mounted on the base. Each terminal includes a body portion fixed in the base, a contacting portion extending upwardly and rearwardly from the body portion and exposed in the receiving cavity, and a mounting portion extending rearwardly from the body portion for mounting on the internal circuit board.

Other objects, advantages and novel features of the invention will become more apparent from the following detailed description when taken in conjunction with the accompanying drawings.

DETAILED DESCRIPTION OF THE INVENTION

Figure 1:
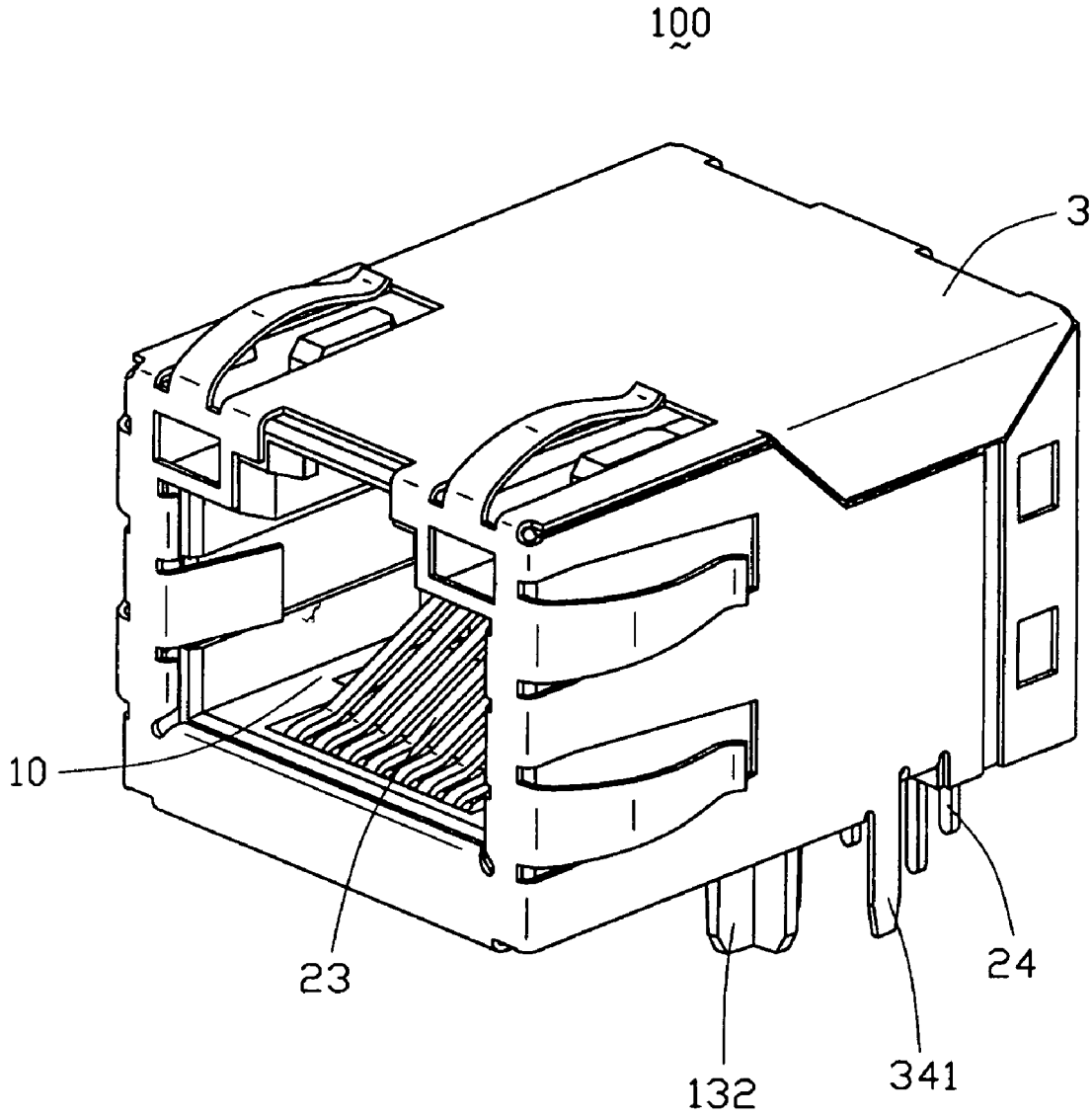
FIG. 1 is a perspective view of an electrical connector according to the present invention.
Figure 2:
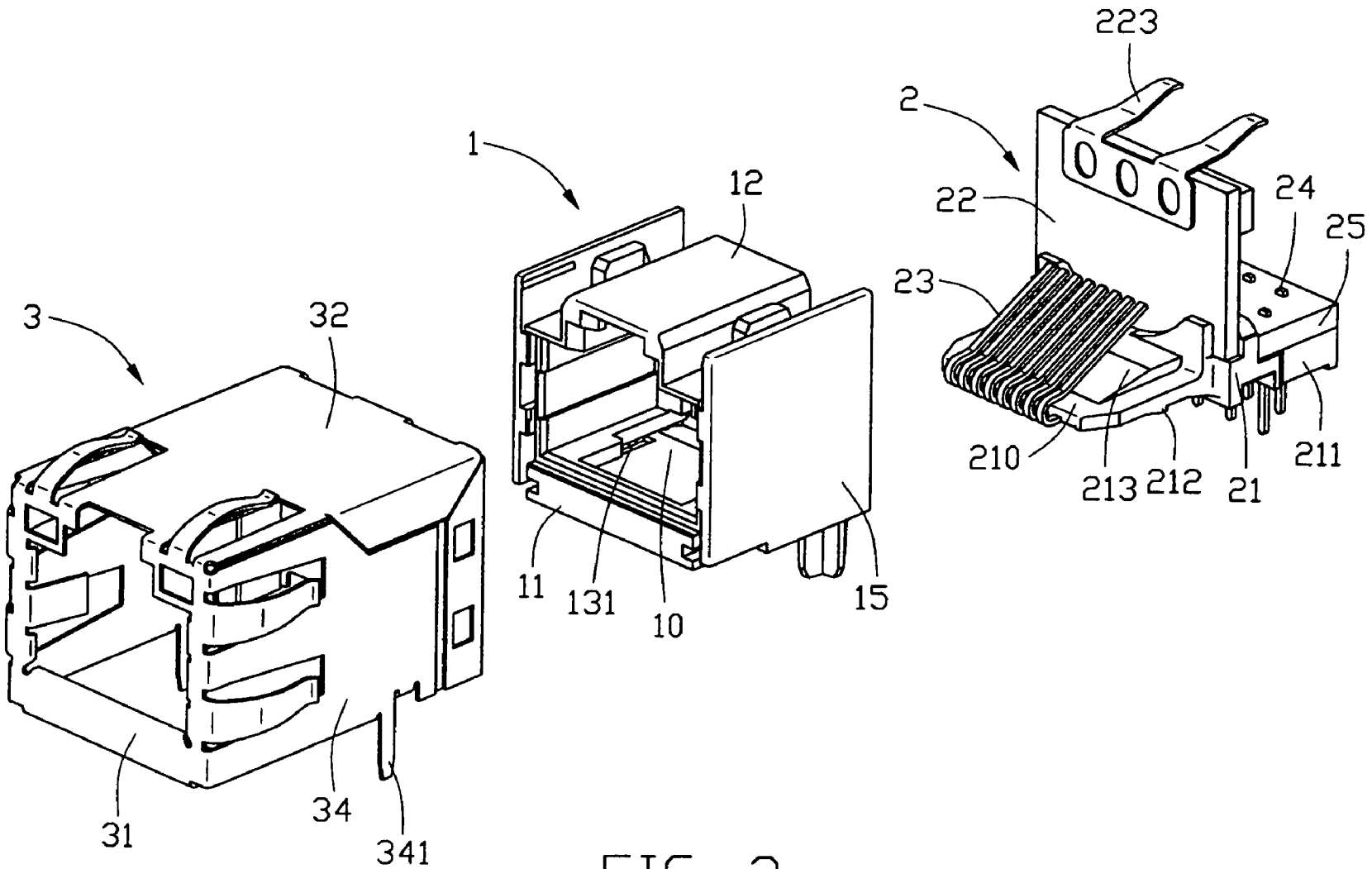
FIG. 2 is a partially assembled view of FIG. 1.

Referring to FIGS. 1 and 2, an electrical connector 100 of the present invention mounted on a main printed circuit board (PCB, not shown) comprises an dielectric housing 1, an insert module 2 arranged in a rear portion of the housing 1 and a metallic outer shell 3 shielding the housing 1.

Figure 3:
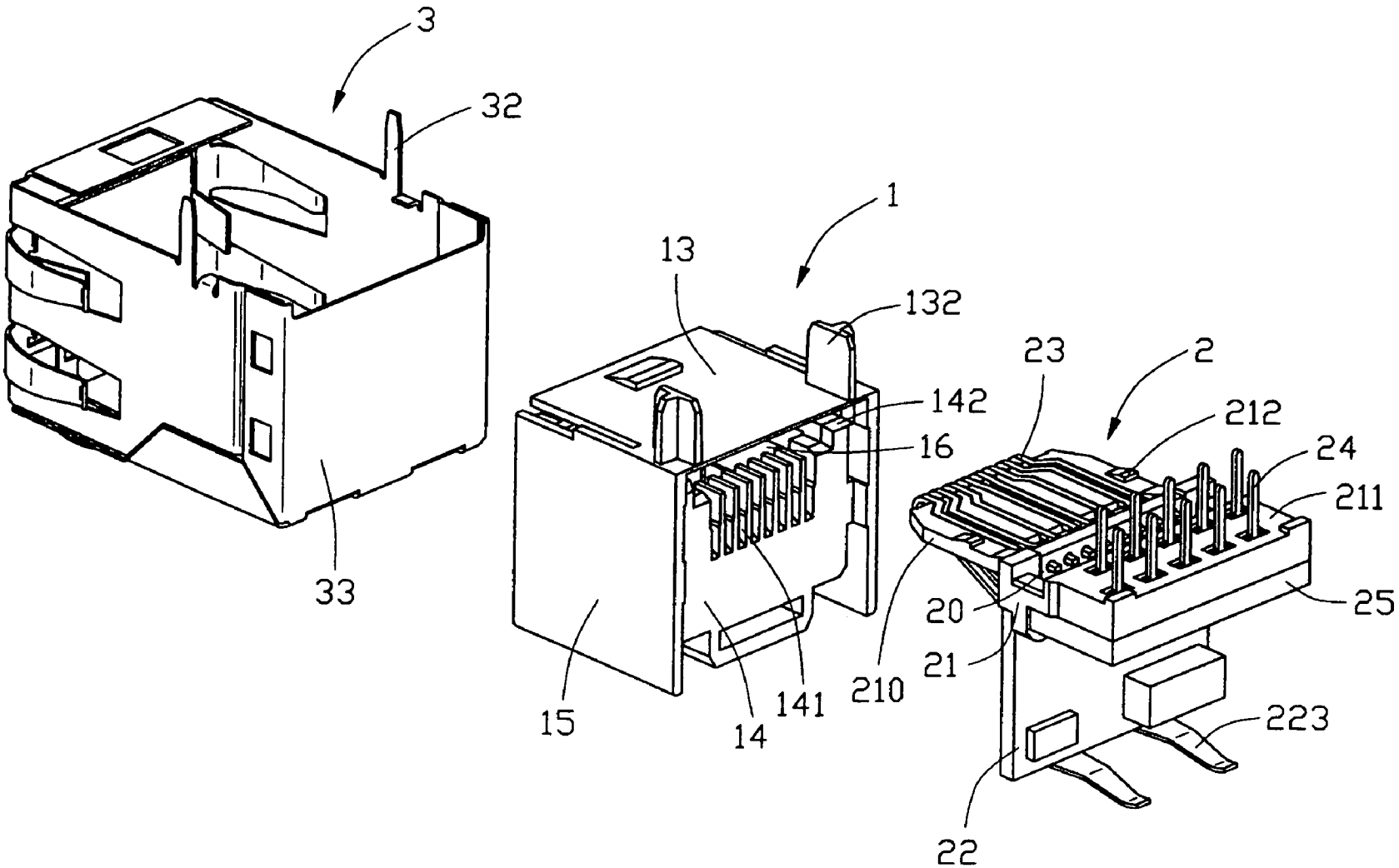
FIG. 3 is another partially assembled view of FIG. 1.
Figure 4:
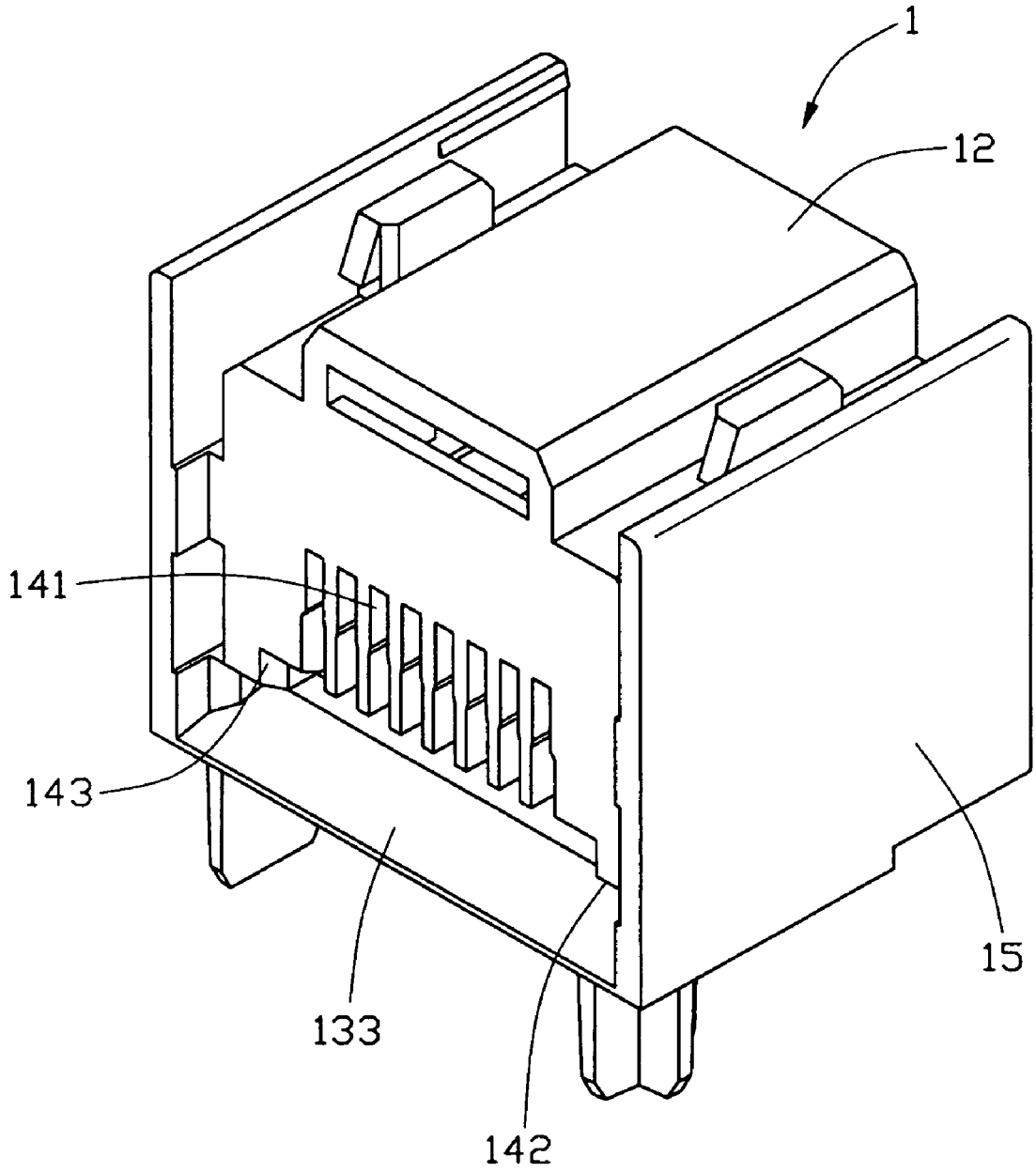
FIG. 4 is a perspective view of a dielectric housing shown in FIG. 2 taken from a rear aspect.

Referring to FIGS. 2, 3 and 4, the housing 1 is substantially rectangular shaped and comprises a front wall 11, an upper wall 12, a bottom wall 13, a rear wall 14 and two sidewalls 15. The front wall 11 provides a receiving cavity 10 extending rearwardly toward the rear wall 14 for receiving a complementary connector (not shown). The bottom wall 13 comprises a pair of recesses 131 proximate corresponding sidewalls 15, a pair of positioning posts 132 and an inclined guiding portion 133 arranged at a rear portion thereof. The positioning posts 132 project downwardly from the bottom wall 13 for engaging with the main PCB on which the electrical connector 100 is mounted. A rear opening 16 is in a lower portion of the rear wall 14 and communicates with the receiving cavity 10. A plurality of comb passageways 141 are defined in a middle portion of the rear wall 14 and communicates with the rear opening 16 and the receiving cavity 10. A pair of ladder-shaped holder portions (not labeled) are formed on opposite sides bottom portion of the rear wall 14. The holder portion includes a bottom surface 142 and an inner side surface 143 perpendicular to the bottom surface 142.

Figure 5:
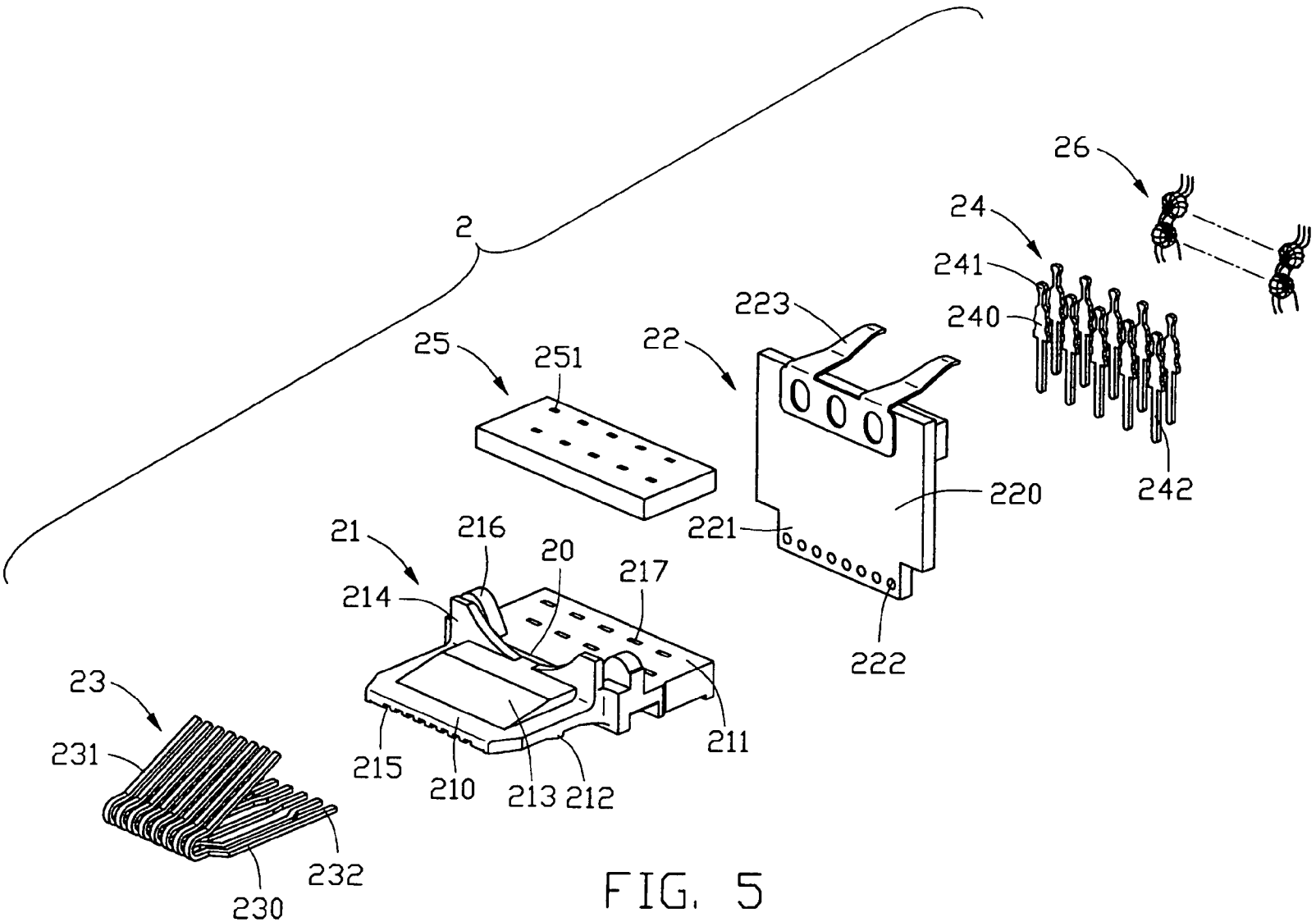
FIG. 5 is an exploded view of an insert module shown in FIG. 2.
Figure 6:
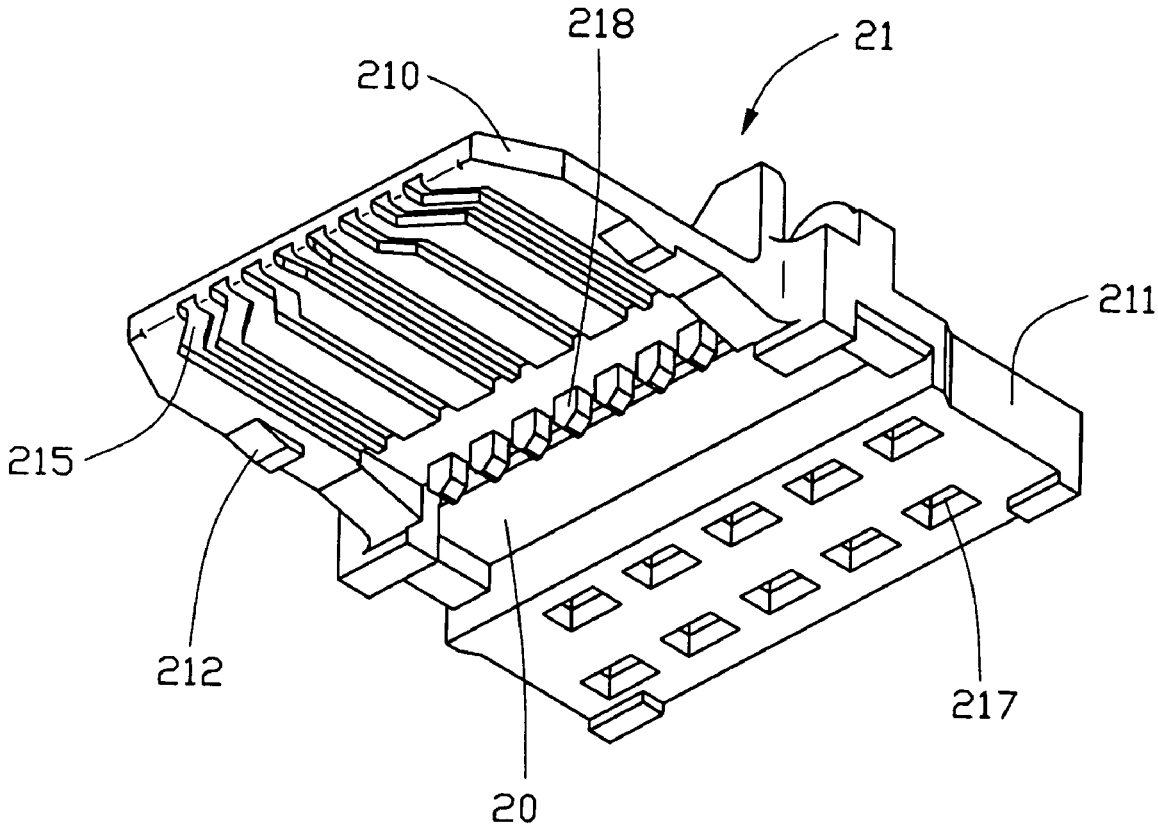
FIG. 6 is a perspective view of insulative base shown in FIG. 5 taken from a bottom aspect.

Referring to FIGS. 5 and 6 in conjunction with FIGS. 2 and 3, the insert module 2 comprises an insulative base 21, a subassembly 22 secured to the base 21, a plurality of conductive terminals 23 for mating with the complementary connector, a plurality of footer pins 24 and a supporting plate 25 defined a number of through holes 251 therein. The supporting plate 25 can be a printed circuit board or other supporting body for acting as a supporting portion.

The insulative base 21 is unitarily molded and is a rectangular plate extending horizontally. The base 21 includes a front section 210, a rear section 211 and a middle groove 20 arranged between the front section 210 and the rear section 211. Two pairs of bounding walls 214, 216 project uprightly from an upper surface of the base 21 and are located respectively on opposite sides of the groove 20. The two pairs of bounding walls 214, 216 have a pair of inner engaging surfaces (not labeled) facing with each other.

The front section 210 of the base 21 comprises a wedge-shaped projecting portion 213 on the upper surface thereof and extending rearwardly to the bounding wall 214, a plurality of passages 215 spaced apart in a bottom surface thereof and a pair of downwardly projecting locking portion 212 on opposite sides of the bottom surface thereof. A plurality of downwardly projecting barrels 218 (shown in FIG. 6) are provided on a rear bottom portion of the front section 210. Arow of slots (not labeled) are defined between two adjacent barrels 218 and communicate with corresponding passages 215. A number of fixing holes 217 are defined in the rear section 211 of the base 21 for receiving corresponding footer pins 24.

Referring to FIGS. 3 and 5, the subassembly 22 includes an internal PCB 220, grounding means 223 and signal conditioning components. The internal PCB 220 is substantially T-shaped and defines a plurality of mounting holes 222 in a lower portion 221 for soldering the conductive terminals 23 therein. The grounding means 223 is arranged on an upper portion of the internal PCB 220 and electrically connects with a grounding trace on the internal PCB 220. The grounding means 223 includes a pair of parallel grounding tabs (not labeled) extending rearwardly from a top surface of the internal PCB 220 and generally perpendicular thereto for electrically connecting with the outer shell 3. The signal conditioning components can include a plurality of common choke coils 26, transformers and LC filter as well as other signal conditioning components such as capacitors ferrite beads and transient suppression diodes. This list of signal conditioning components is not intended to be all inclusive. The subassembly 22 for which this invention is to be used is also not limited to circuitry which can be used to remove noise.

Each conductive terminal 23 includes a horizontal body portion 230, a contacting portion 231 extending upwardly and rearwardly from a front end of the body portion 230 and a mounting portion 232 extending rearwardly from a rear end of the body portion 230.

Each footer pin 24 includes a middle retention portion 240 having a plurality of barbs (not labeled) thereon, an upper soldering portion 241 and a lower soldering portion 242.

Referring to FIGS. 2 and 3 in conjunction with FIG. 1, the outer shell 3 is stamped from a sheet of conductive material and includes a front plate 31, an upper plate 32, a rear plate 33 and two side plates 34. The front plate 31 defines a window (not labeled) corresponding to the receiving cavity 10. Each side plate 34 has a grounding tail 341 projecting downwardly for electrically connecting with a grounding trace of the main PCB.

Referring to FIGS. 5 and 6 in conjunction with FIGS. 2 and 3, in assembly, the first step is to assemble the insert module 2. The lower portion 221 of the internal PCB 220 is received in the groove 20 of the insulative base 21 with the mounting holes 222 downwardly beyond the groove 20 the base 21. The engaging surfaces of the bounding walls 214, 216 respectively abut against a front and rear surface of the internal PCB 220. The conductive terminals 23 are assembled to the front section 210 of the base 21. The body portion 230 of each terminal 23 is received in a corresponding passage 215 of the base 21. The mounting portion 232 of each terminal 23 extends rearwardly through a corresponding slot between the adjacent two barrels 218 and is soldered in a corresponding mounting hole 222 of the internal PCB 220. The footer pins 24 are fixed in the rear section 211 of the base 21 with the upper and lower soldering portion 241, 242 extending beyond the upper and bottom surface of the base 21. The supporting plate 25 is assembled to the rear section 211 of the base 21. The upper soldering portions 241 of the footer pins 24 extend through the corresponding through 251 of the supporting plate 25. One end of each common choke coil 26 is soldered to the internal PCB 220, the other end of the common choke coil 26 is soldered with a corresponding upper soldering portion 241 of the footer pin 24 on the supporting plate 25, thereby forming electrical connections between the terminals 23 and the footer pins 24 via the internal PCB 220 and the common choke coil 26. It can be seen that the signal conditioning components are electrically connected between corresponding pairs of terminals 23 and the footer pins 24.

Referring to FIGS. 1 through 4, secondly, the insert module 2 is inserted into the housing 1 in a rear-to-front direction. The front section 210 of the base 21 slides along the inclined guiding portion 133 of the bottom wall 13 and extends into the receiving cavity 10. The terminals 23 extend through respective ones of the passageways 141 with contacting portions 231 exposed in the receiving cavity 10. The locking portions 212 of the base 21 are held in the recess 131 of the bottom wall 13 of the housing 1. The bottom surface 142 of the rear wall 14 of the housing 1 abuts against the upper surface of the front section 210 of the base 21, and the inner side surfaces 143 bias against the side surfaces of the projecting portion 213 of the base 21, thereby stabilizing orientation of the terminals 23. Finally, the outer shell 3 is placed over the housing 1. The grounding tabs of the grounding means 223 mechanically and electrically connect with the rear plate 33 of the outer shell 3.

It should be noted that the supporting plate 25 is only act as a supporting portion for which the footer pins 24 and the common chock coil soldered together thereon. The present invention also cannot include the supporting plate 25.

It also should be noted that solder joints between the internal PCB 220, the common chock coils and the footer pins can be encapsulated by a dielectric colloid to ensure their internal connections. The structure and the function of the dielectric colloid are well known to those skilled in the art, a detailed description is omitted herein.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing defining a receiving cavity;

an insert module received in the housing and comprising:

an insulative base defining a groove therein;

an internal circuit board fixed in the groove of the base; and a conductive terminal including a body portion fixed in the base, a contacting portion extending upwardly and rearwardly from the body portion and exposed in the receiving cavity, and a mounting portion extending rearwardly from the body portion for mounting on the internal circuit board;

wherein the base includes a front and rear sections, the groove being defined between the front and rear sections and extending through the base;

wherein the insert module includes a footer pin and a common choke coil, and the rear section of the base defines a fixing hole for receiving the footer pin therein, one end of each common choke coil electrically connecting with the internal circuit board, the other end of the common choke coil electrically connecting with the footer pin;

wherein the insert module further includes a supporting plate defining a through hole therein and being mounted on the rear section of the base, the footer pin extending through the through hole to electrically connect with the common choke coil;

wherein a metallic outer shell surrounding the housing and a grounding means electrically attached to an end of the internal circuit board, the grounding means having grounding tabs extended upwardly from the end and electrically connecting with the outer shell.

2. The electrical connector according to claim 1, wherein the base defines a pair of bounding walls on opposite sides of the groove, the bounding walls projecting from the base for securing the internal circuit board therebetween.

3. The electrical connector according to claim 1, wherein the front section of the base defines a passage therein, the body portion of the conductive terminal being received in the passage.

4. The electrical connector according to claim 1, wherein the internal circuit board has an end defining a mounting hole for engaging with the mounting portion of the terminal, the end extending beyond the groove.

5. The electrical connector according to claim 1, wherein the housing defines a recess therein, and wherein the base has a projecting locking portion held in the recess.

* * * * *